US007604372B2

(12) United States Patent
Chen

(10) Patent No.: US 7,604,372 B2
(45) Date of Patent: Oct. 20, 2009

(54) LAMP MODULE

(76) Inventor: Ching-Hui Chen, 6F.-1, No. 11, Lane 238, Sihping Rd., Taichung 406 (TW)

( * ) Notice: Subject to any disclaimer, the term of this patent is extended or adjusted under 35 U.S.C. 154(b) by 0 days.

(21) Appl. No.: 12/100,784

(22) Filed: Apr. 10, 2008

(65) Prior Publication Data

US 2008/0316738 A1 Dec. 25, 2008

(51) Int. Cl.
*F21V 21/008* (2006.01)

(52) U.S. Cl. ..... 362/217.08; 362/217.05; 362/147; 362/404; 362/408; 362/306

(58) Field of Classification Search ..... 362/217.02, 362/217.05, 217.08, 217.06, 147, 404, 408, 362/296.01, 306, 341
See application file for complete search history.

(56) References Cited

U.S. PATENT DOCUMENTS 3,609,337 A * 9/1971 Adra et al. ..... 362/306
4,078,169 A * 3/1978 Armstrong ..... 362/122
4,460,942 A * 7/1984 Pizzuti et al. ..... 362/16

* cited by examiner

*Primary Examiner*—Laura Tso
(74) *Attorney, Agent, or Firm*—Fulwider Patton LLP

(57) ABSTRACT

A lamp module includes: a single piece of a mounting base including an arcuate mounting plate defining two retaining recesses, and a bracket extending upwardly from the mounting plate; two socket units mounted respectively on two opposite ends of the bracket, each of the socket units being formed with pin holes adapted to receive pins of a fluorescent tube; an arcuate reflective plate having two opposite lower ends received in the retaining recesses in the mounting plate; and a pair of connectors provided on the sockets units and having pins for insertion into pin holes in sockets of a ceiling lamp suspending holder.

5 Claims, 4 Drawing Sheets

LAMP MODULE

CROSS REFERENCE TO RELATED APPLICATION

This application claims priority of Taiwanese application no. 096209994, filed on Jun. 20, 2007.

BACKGROUND OF THE INVENTION

1. Field of the Invention

The invention relates to a lamp module, more particularly to a lamp module including a bracket with a reflective plate and a pair of connectors for connecting respectively to sockets of a ceiling lamp suspending holder.

2. Description of the Related Art

FIG. 1 illustrates a conventional ceiling lamp suspending holder 100 with sockets 102 for insertion of pins 101 of a fluorescent tube 10 therein. The conventional ceiling lamp suspending holder 100 is disadvantageous in that it does not have a light concentrating function.

SUMMARY OF THE INVENTION

Therefore, an object of the present invention is to provide a lamp module having a light concentrating function.

Accordingly, a lamp module of the present invention is adapted to be connected to sockets of a ceiling lamp suspending holder and comprises: a single piece of a mounting base including an arcuate mounting plate that has a top segment and two opposite lower segments extending downwardly and curvedly from the top segment in opposite directions to define a lamp-receiving space thereamong for receiving a fluorescent tube therein, each of the lower segments having a bent lower end that defines a retaining recess, the mounting base further including a bracket extending upwardly from the top segment of the mounting plate and having two opposite lateral ends; a pair of socket units mounted respectively on the opposite lateral ends of the bracket, each of the socket units being formed with pin holes adapted to receive pins of the fluorescent tube therein; an arcuate reflective plate disposed in the lamp-receiving space and having two opposite lower ends received in the retaining recesses in the lower ends of the lower segments of the mounting plate; and a pair of connectors provided respectively on the socket units and having pins adapted to be inserted into pin holes in the sockets of the ceiling lamp suspending holder, respectively.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
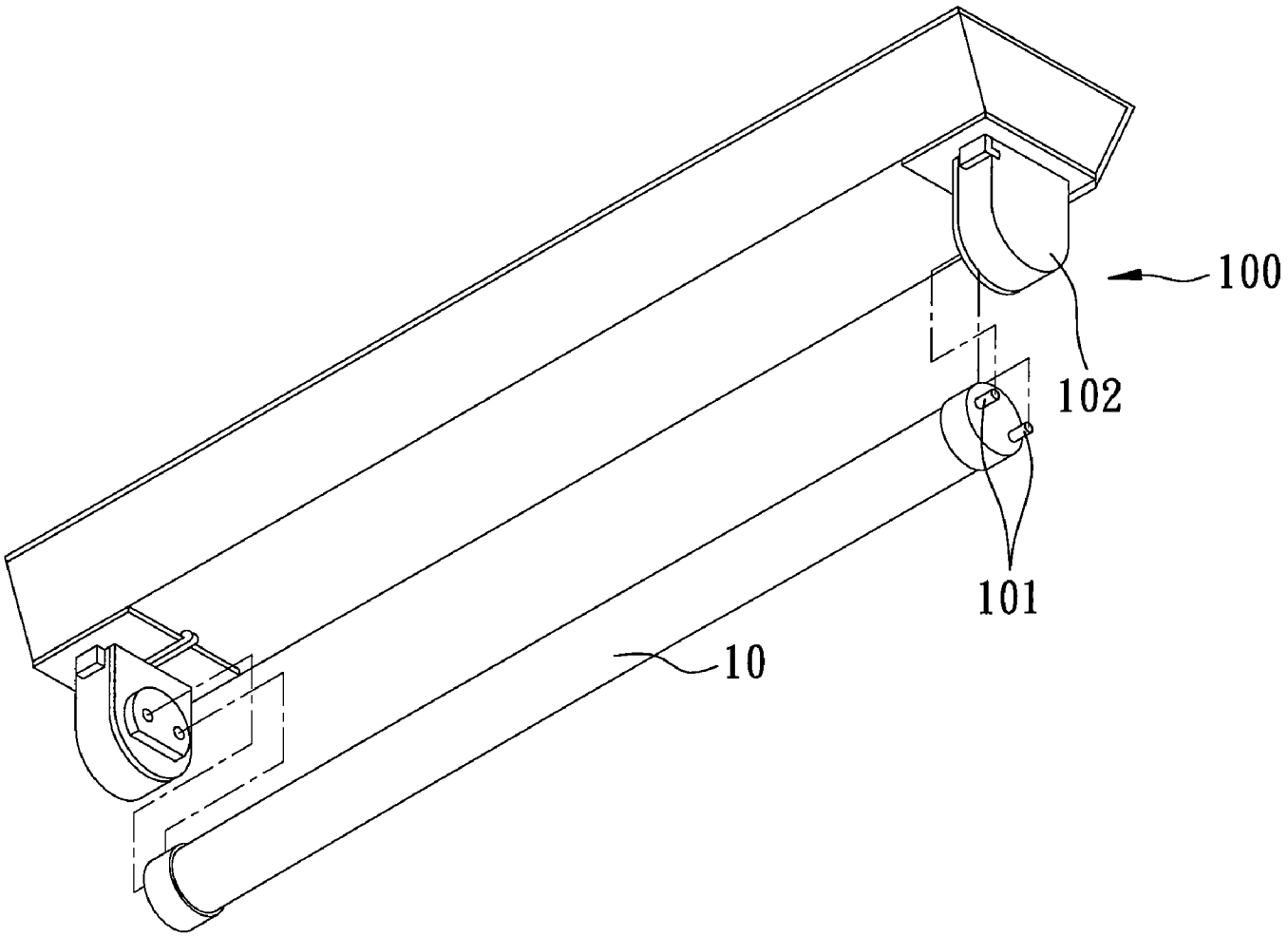
FIG. 1 PRIOR ART
FIG. 1 is a perspective view of a conventional ceiling lamp suspending holder.
Figure 2:
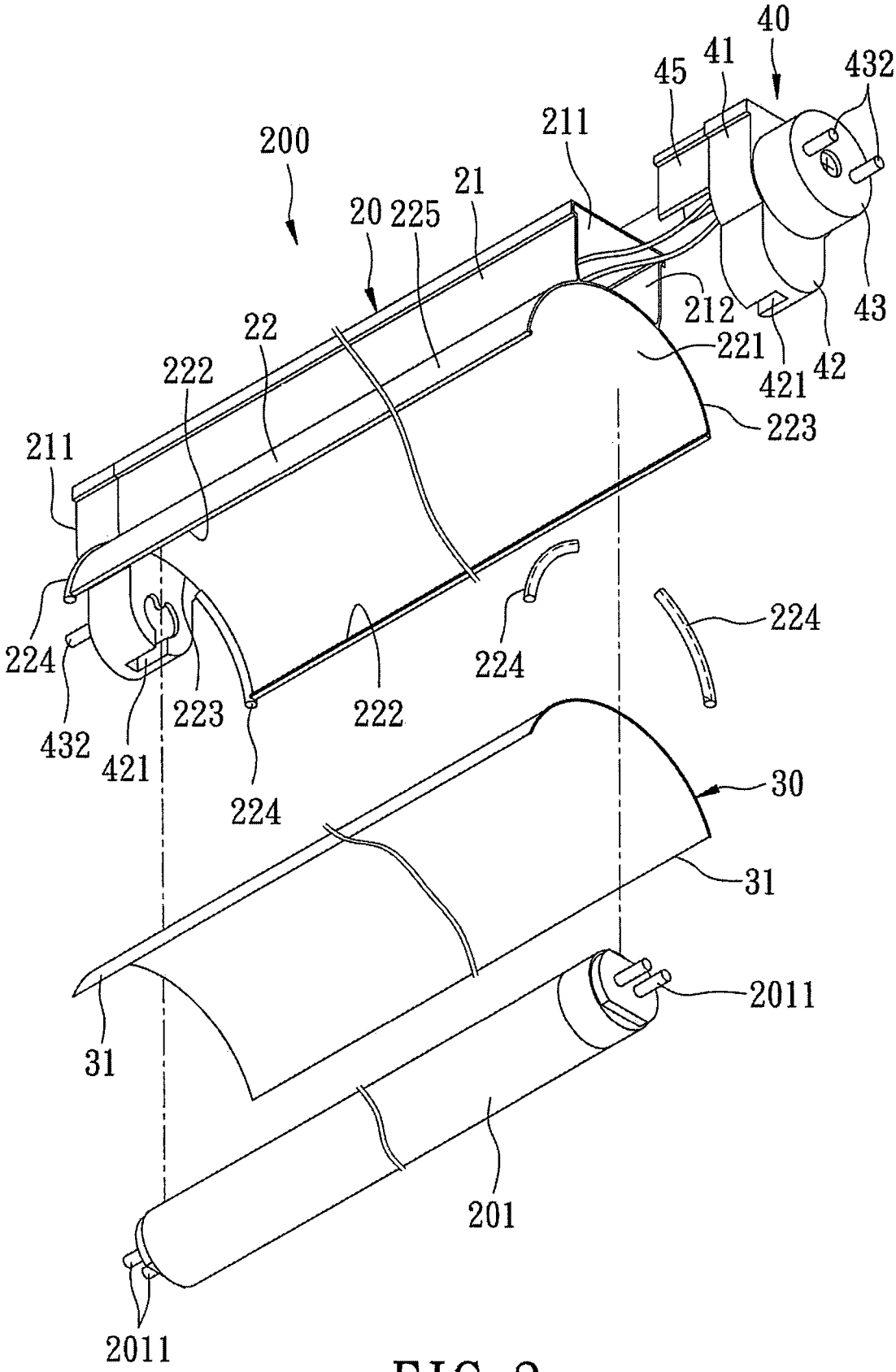
FIG. 2 is an exploded view of the preferred embodiment of a lamp module according to the present invention.
Figure 3:
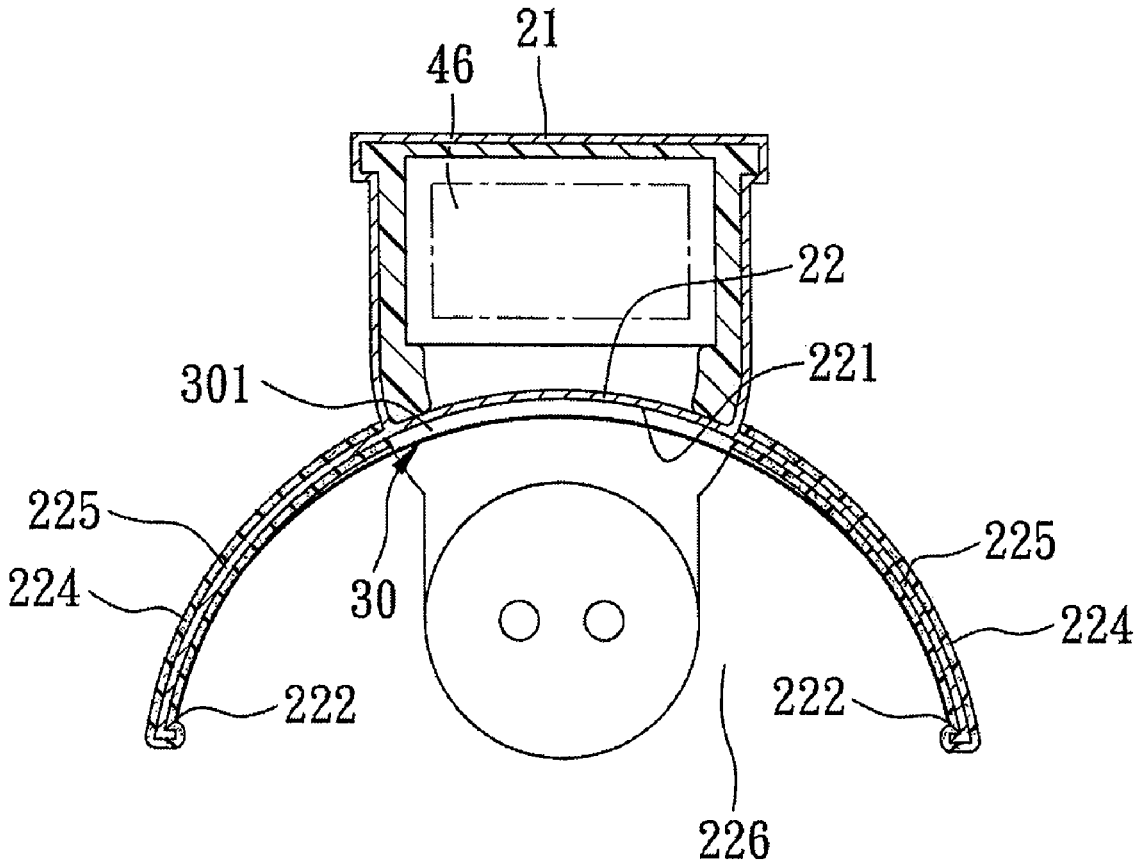
FIG. 3 is a sectional view of the preferred embodiment.
Figure 4:
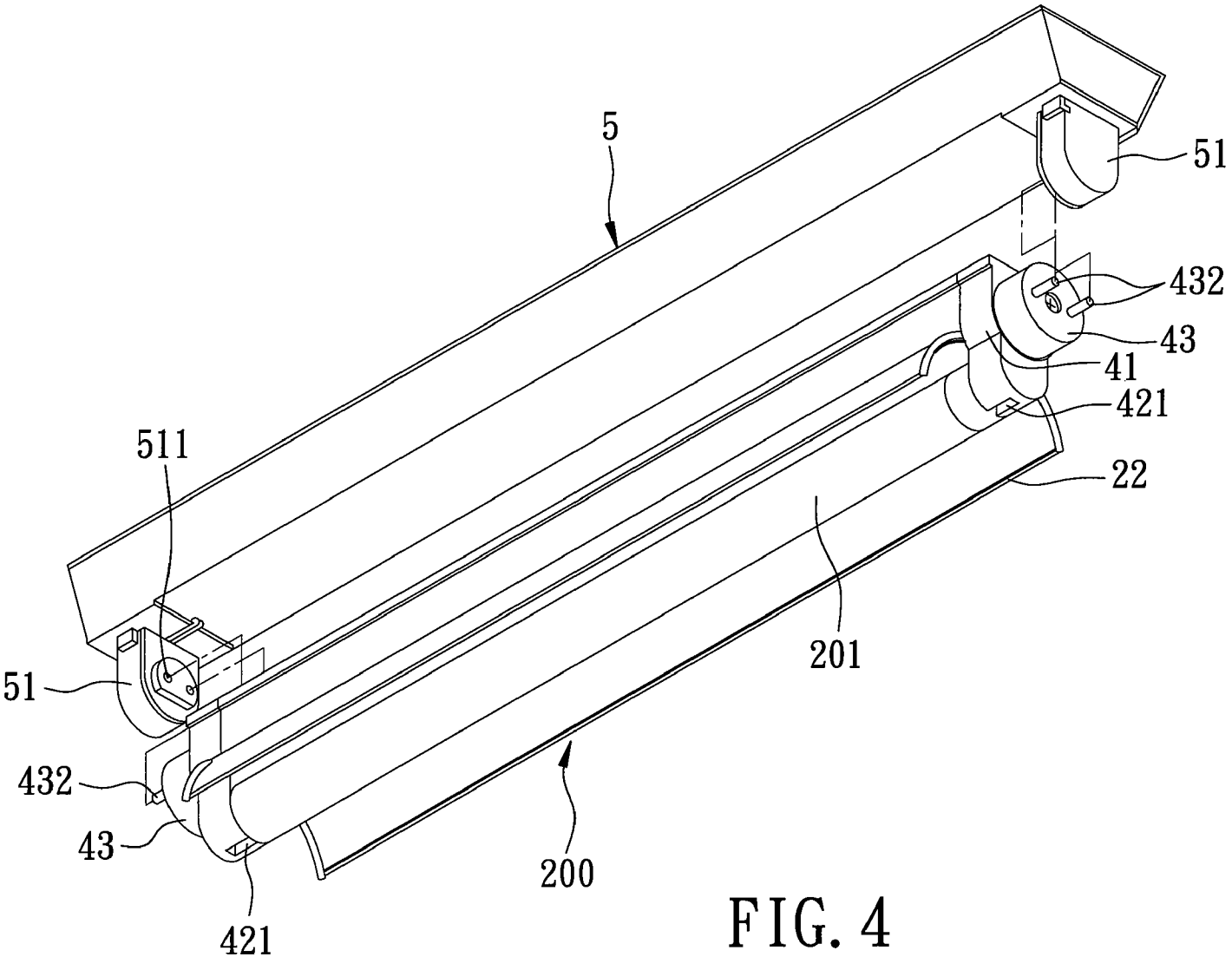
FIG. 4 is an assembled perspective view of the preferred embodiment for mounting to a conventional ceiling lamp suspending holder.

Referring to FIGS. 2 to 4, the preferred embodiment of a lamp module 200 according to the present invention is shown to be adapted to be connected to sockets 51 of a ceiling lamp suspending holder 5, and includes: a single piece of a mounting base 20 including an arcuate mounting plate 22 that has a top segment 221 and two opposite lower segments 225 extending downwardly and curvedly from the top segment 221 in opposite directions to define a lamp-receiving space 226 thereamong for receiving a fluorescent tube 201 therein, each of the lower segments 225 having a bent lower end that defines a retaining recess 222, the mounting base 20 further including a bracket 21 extending upwardly from the top segment 221 of the mounting plate 22 and having two opposite lateral ends 211; a pair of socket units 40 mounted respectively on the opposite lateral ends 211 of the bracket 21, each of the socket units 40 being formed with pin holes 421 adapted to receive pins 2011 of the fluorescent tube 201 therein; an arcuate reflective plate 30 disposed in the lamp-receiving space 226 and having two opposite lower ends 31 received in the retaining recesses 222 in the lower ends of the lower segments 222 of the mounting plate 22; and a pair of connectors 43 provided respectively on the socket units 40 and having pins 432 adapted to be inserted into pin holes 511 in the sockets 51 of the ceiling lamp suspending holder 5, respectively.

In this embodiment, the mounting base 20 is made from an aluminum extrudate. The bracket 21 is hollow, and defines an inner space 212 therein. Each of the socket units 40 has a hollow upper part 41, an insert 45 extending laterally from the upper part 41 and inserted into the inner space 212 in the bracket 21, and a lower part 42 extending downwardly from the upper part 41 and formed with the pin holes 421. The lamp module 200 further includes a starter 46 disposed in the upper part 41 (see FIG. 3) and adapted to actuate the fluorescent tube 201.

Each of the connectors 43 extends laterally from and is disposed at an opposite side of the upper part 41 opposite to the insert 45.

The mounting plate 22 has two opposite lateral ends 223. The lamp module 200 further includes a pair of protective sleeves 224 sleeved on the lower segments 225 of the mounting plate 22 at each one of the lateral ends 223 of the mounting plate 22 for safety purposes.

In this embodiment, the reflective plate 30 is made of metal, and cooperates with the mounting plate 22 to define an arcuate gap 301 therebetween for thermal insulation purposes.

The lamp module 200 of this invention can provide a light concentrating function, and can be easily connected to the conventional ceiling lamp suspending holder 5.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lamp module adapted to be connected to sockets of a ceiling lamp suspending holder, comprising:

a single piece of a mounting base including an arcuate mounting plate that has a top segment and two opposite lower segments extending downwardly and curvedly from said top segment in opposite directions to define a lamp-receiving space thereamong for receiving a fluorescent tube therein, each of said lower segments having a bent lower end that defines a retaining recess, said mounting base further including a bracket extending upwardly from said top segment of said mounting plate and having two opposite lateral ends;

a pair of socket units mounted respectively on said opposite lateral ends of said bracket, each of said socket units being formed with pin holes adapted to receive pins of the fluorescent tube therein;

an arcuate reflective plate disposed in said lamp-receiving space and having two opposite lower ends received in said retaining recesses in said lower ends of said lower segments of said mounting plate; and a pair of connectors provided respectively on said socket units and having pins adapted to be inserted into pin holes in the sockets of the ceiling lamp suspending holder, respectively.

2. The lamp module as claimed in claim 1, wherein said mounting base is made from an aluminum extrudate.

3. The lamp module as claimed in claim 1, wherein said bracket is hollow and defines an inner space therein, each of said socket units having a hollow upper part, an insert extending laterally from said upper part and inserted into said inner space in said bracket, and a lower part extending downwardly from said upper part and formed with said pin holes, said lamp module further comprising a starter disposed in said upper part and adapted to actuate the fluorescent tube.

4. The lamp module as claimed in claim 1, wherein said mounting plate has two opposite lateral ends, said lamp module further comprising a pair of protective sleeves sleeved on said lower segments of said mounting plate at each one of said lateral ends of said mounting plate.

5. The lamp module as claimed in claim 1, wherein said reflective plate cooperates with said mounting plate to define an arcuate gap therebetween.

* * * * *

UNITED STATES PATENT AND TRADEMARK OFFICE

CERTIFICATE OF CORRECTION

PATENT NO. : 7,604,372 B2
APPLICATION NO. : 12/100784
DATED : October 20, 2009
INVENTOR(S) : Chen It is certified that error appears in the above-identified patent and that said Letters Patent is hereby corrected as shown below:

Title page, insert --[30] Foreign Application Priority Data Jun. 20, 2007 [TW] Taiwan 096209994--.

Signed and Sealed this

Twenty-ninth Day of December, 2009

David J. Kappos

David J. Kappos
*Director of the United States Patent and Trademark Office*